US009568928B2

(12) United States Patent
Meyers

(10) Patent No.: US 9,568,928 B2
(45) Date of Patent: Feb. 14, 2017

(54) COMPENSATED VOLTAGE REFERENCE GENERATION CIRCUIT AND METHOD

(71) Applicant: Semiconductor Components Industries, LLC, Phoenix, AZ (US)

(72) Inventor: Manuel Meyers, Leuven (BE)

(73) Assignee: SEMICONDUCTOR COMPONENTS INDUTRIES, LLC, Phoenix, AZ (US)

( * ) Notice: Subject to any disclaimer, the term of this patent is extended or adjusted under 35 U.S.C. 154(b) by 0 days.

(21) Appl. No.: 14/480,970

(22) Filed: Sep. 9, 2014

(65) Prior Publication Data

US 2015/0084686 A1 Mar. 26, 2015

Related U.S. Application Data

(60) Provisional application No. 61/881,940, filed on Sep. 24, 2013.

(51) Int. Cl.

| | |
|---|---|
| ***G05F 1/10*** | (2006.01) |
| ***G05F 1/567*** | (2006.01) |
| ***G05F 3/16*** | (2006.01) |
| ***G05F 1/46*** | (2006.01) |

(52) U.S. Cl.

CPC ..... *G05F 1/567* (2013.01); *G05F 1/463* (2013.01); *G05F 3/16* (2013.01)

(58) Field of Classification Search

USPC ..... 327/539, 513; 323/314

See application file for complete search history.

(56) References Cited

U.S. PATENT DOCUMENTS

| | | | | |
|---|---|---|---|---|
| 4,443,753 | A * | 4/1984 | McGlinchey | 323/313 |
| 5,352,973 | A * | 10/1994 | Audy | G05F 3/30 323/313 |
| 5,479,092 | A * | 12/1995 | Pigott | G05F 1/463 323/313 |
| 5,767,664 | A * | 6/1998 | Price | 323/313 |
| 6,121,824 | A * | 9/2000 | Opris | 327/539 |
| 6,329,804 | B1 * | 12/2001 | Mercer | G05F 3/30 323/314 |
| 7,248,098 | B1 * | 7/2007 | Teo | 327/539 |
| 7,420,359 | B1 * | 9/2008 | Anderson et al. | 323/316 |
| 7,449,872 | B2 * | 11/2008 | Zolfaghari | 323/314 |
| 8,493,130 | B2 * | 7/2013 | Fukazawa et al. | 327/513 |
| 8,540,423 | B2 * | 9/2013 | Liu | 374/178 |

(Continued)

*Primary Examiner* — Thomas J Hiltunen

(74) *Attorney, Agent, or Firm* — Rennie William Dover

(57) ABSTRACT

In accordance with an embodiment, a method of compensating for the temperature coefficient of a reference voltage includes generating a reference voltage that varies over temperature. A temperature compensated reference voltage is generated that compensates for a temperature variation in the voltage value of the reference voltage. In accordance with another embodiment, a temperature compensation circuit that compensates for temperature variation of a reference voltage is includes a reference voltage generator circuit having an output. A first impedance branch is coupled to the output of the reference voltage generator circuit and a second impedance branch is coupled to the output of the reference voltage generator circuit. A transconductance generation circuit having a first terminal connected to the first impedance branch and a second terminal connected to the second impedance branch.

21 Claims, 9 Drawing Sheets

(56) References Cited

U.S. PATENT DOCUMENTS

| | | | | |
|---|---|---|---|---|
| 8,786,358 | B2 * | 7/2014 | Endo | G05F 3/245 327/513 |
| 8,829,885 | B2 * | 9/2014 | Otsuka | G05F 1/561 323/316 |
| 2008/0054871 | A1 | 3/2008 | Anzai | |
| 2008/0106326 | A1 | 5/2008 | Gaggl | |
| 2010/0301832 | A1 | 12/2010 | Katyal et al. | |
| 2014/0084989 | A1 * | 3/2014 | Fujime | G05F 1/575 327/513 |

* cited by examiner

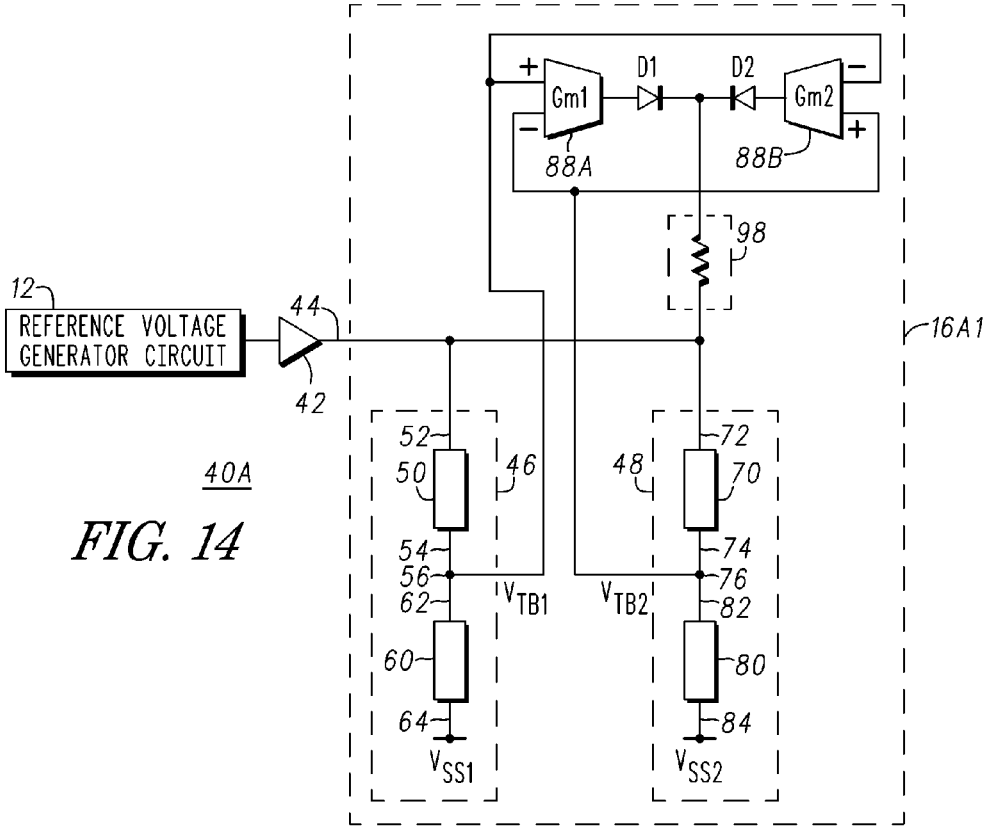
FIG. 14
FIG. 18
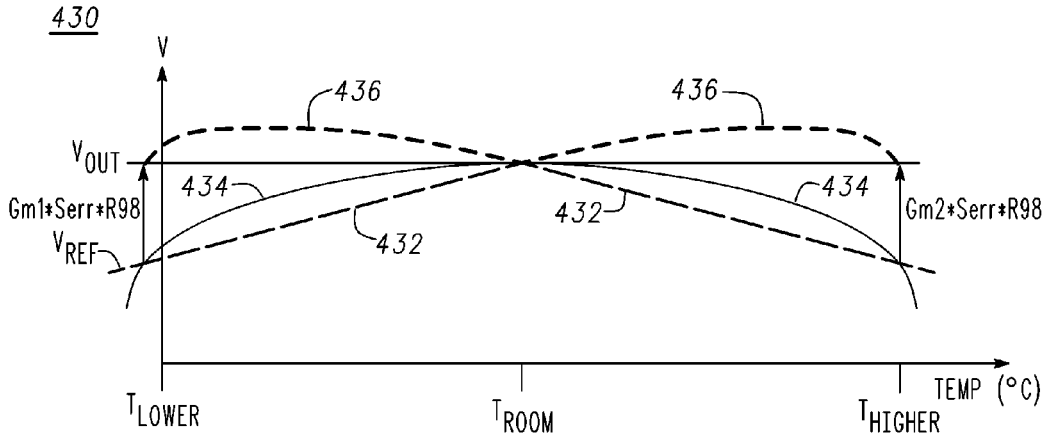

400

420

COMPENSATED VOLTAGE REFERENCE GENERATION CIRCUIT AND METHOD

TECHNICAL FIELD

The present invention relates, in general, electronics and, more particularly, to semiconductor structures thereof, and methods of forming semiconductor devices.

BACKGROUND

In the past, the semiconductor industry used various methods and structures to form voltage reference circuits. The voltage reference circuits generally were used to supply a stable reference voltage for use by other circuits such as a comparator circuit. One commonly used design technique to form the voltage reference circuits used a bandgap reference as a portion of the voltage reference circuit. One design parameter for the prior voltage reference circuits was to reduce variations in the reference voltage that resulted from variations in temperature. One example of a prior voltage reference circuit that included temperature compensation was disclosed in U.S. Pat. No. 7,692,476, titled "Temperature Compensating Circuit" issued to Ryoichi Anzai on Apr. 6, 2010. However, such prior voltage reference circuits did not provide sufficient temperature stabilization over an extended temperature range.

Accordingly, it would be advantageous to have a voltage reference circuit that has improved temperature compensation. It would be of further advantage for the structure and method to be cost efficient to implement.

BRIEF DESCRIPTION OF THE DRAWINGS

The present invention will be better understood from a reading of the following detailed description, taken in conjunction with the accompanying drawing figures, in which like reference characters designate like elements and in which:

FIG. 14 is a circuit schematic of a semiconductor component that includes a compensation circuit coupled to a reference voltage generator in accordance with another embodiment of the present invention;

FIG. 18 is a plot of output voltage versus temperature in accordance with an embodiment of the present invention.

Figure 1:
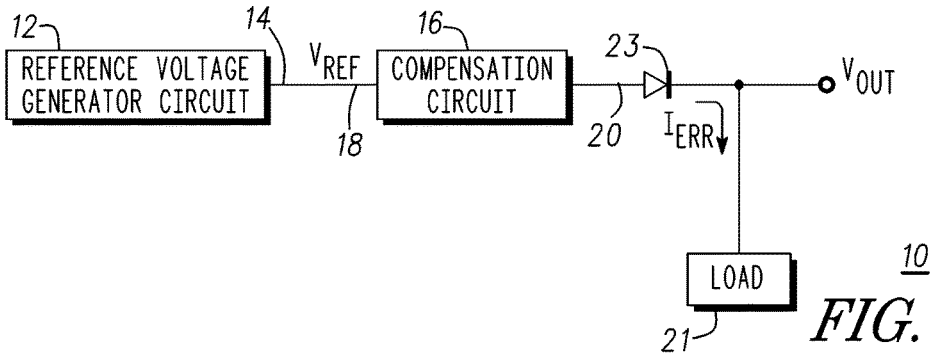
FIG. 1 is a block diagram of a semiconductor component that includes a compensation circuit coupled to a reference voltage generator in accordance with an embodiment of the present invention.

For simplicity and clarity of illustration, elements in the figures are not necessarily to scale, and the same reference characters in different figures denote the same elements. Additionally, descriptions and details of well-known steps and elements are omitted for simplicity of the description. As used herein current carrying electrode means an element of a device that carries current through the device such as a source or a drain of an MOS transistor or an emitter or a collector of a bipolar transistor or a cathode or anode of a diode, and a control electrode means an element of the device that controls current flow through the device such as a gate of an MOS transistor or a base of a bipolar transistor. Although the devices are explained herein as certain n-channel or p-channel devices, or certain n-type or p-type doped regions, a person of ordinary skill in the art will appreciate that complementary devices are also possible in accordance with embodiments of the present invention. It will be appreciated by those skilled in the art that the words during, while, and when as used herein are not exact terms that mean an action takes place instantly upon an initiating action but that there may be some small but reasonable delay, such as a propagation delay, between the reaction that is initiated by the initial action. The use of the words approximately, about, or substantially means that a value of an element has a parameter that is expected to be very close to a stated value or position. However, as is well known in the art there are always minor variances that prevent the values or positions from being exactly as stated. It is well established in the art that variances of up to about ten percent (10%) (and up to twenty percent (20%) for semiconductor doping concentrations) are regarded as reasonable variances from the ideal goal of exactly as described.

DETAILED DESCRIPTION

Generally, the present invention provides a semiconductor component such as, for example a temperature compensated reference voltage and a method for compensating or correcting for variations in output voltage in response to temperature changes. In accordance with an embodiment, the semiconductor component comprises a compensated reference voltage generation circuit in accordance with an embodiment of the present invention that includes a reference voltage generator circuit coupled to compensation circuit.

In accordance with an embodiment, a method of compensating for temperature variation of a reference voltage, comprises providing a reference voltage, wherein a voltage value of the reference voltage varies over temperature and applying the reference voltage to a first impedance network and to a second impedance network, wherein the first impedance network includes a first impedance element with a first temperature coefficient and the second impedance network includes a second impedance element having a second temperature coefficient, the second temperature coefficient different from the first impedance element. The method further includes generating a first voltage and a second voltage in response to the reference voltage applied to the first impedance network and to the second impedance network and generating a compensation signal in response to the first voltage and the second voltage.

In accordance with another embodiment, the first voltage and the second voltage form a differential voltage and generating the compensation signal includes generating an error current in response to the differential voltage and generating an error voltage in response to the error current.

In accordance with another embodiment, an error voltage is added to a reference voltage to generate a temperature compensated reference voltage.

In accordance with another embodiment, the method includes generating the first voltage in response to applying the reference voltage to the first impedance network and generating the second voltage in response to applying the reference voltage to the second impedance network.

In accordance with another embodiment, the method includes generating the error current in response to applying the differential reference voltage to a transconductance circuit.

In accordance with another embodiment, the method includes using the error current to generate the temperature compensated reference voltage includes directing the error current through an impedance.

In accordance with another embodiment, the method includes controlling a direction in which the error current flows.

In accordance with another embodiment, the method includes changing the error current proportionally with the transconductance.

In accordance with another embodiment, the method includes generating the compensation signal in response to the first voltage and the second voltage by injecting the error current into a bandgap reference circuit.

In accordance with another embodiment, generating the first voltage and the second voltage further includes trimming the at least one of the first voltage and the second voltage to be equal at a first temperature.

In accordance with another embodiment, the first impedance network includes a third impedance element coupled to the second impedance element at a first node, the second impedance network includes a fourth impedance element coupled to the second impedance element at a second node, and generating the first voltage and the second voltage in response to the reference voltage applied to the first impedance element and to the second impedance element includes generating the first voltage at the first node and generating the second voltage at the second node.

In accordance with another embodiment, the first and second voltages form a differential voltage.

In accordance with another embodiment, the first and second voltages are set to be equal at a first temperature.

In accordance with another embodiment, the method includes generating an error current in response to the differential voltage using a nonlinear transconductance parameter.

In accordance with another embodiment, a temperature compensation circuit that compensates for temperature variation of a reference voltage is provided that, comprises a first impedance branch coupled for receiving a reference voltage, a second impedance branch coupled for receiving the reference voltage, and a transconductance generation circuit having a first input, a second input, and an output, the first input coupled to the first impedance branch and the second input coupled to the second impedance branch.

In accordance with another embodiment, the input of the transconductance generation circuit is a differential input and the output of the transconductance generation circuit is a single ended output.

In accordance with another embodiment, the first impedance branch comprises a first impedance element having first and second terminals, the first terminal of the first impedance element coupled to the output of the voltage reference generator circuit and a second impedance element having first and second terminals, the first terminal of the second impedance element coupled to the second terminal of the first impedance element to form a first node and the second terminal of the second impedance element coupled for receiving a first source of potential, wherein the first node is coupled to the first input of the first transconductance generation circuit. The second impedance branch comprises a third impedance element having first and second terminals, the first terminal of the third impedance element coupled to the output of the voltage reference generator circuit, and a fourth impedance element having first and second terminals, the first terminal of the fourth impedance element coupled to the second terminal of the third impedance element to form a second node and the second terminal of the fourth impedance element coupled for receiving a second source of potential, wherein the second node is coupled to the second input of the transconductance generation circuit.

In accordance with another embodiment, the first impedance element is a first resistor, the second impedance element is a second resistor, the third impedance element is a third resistor, and the fourth impedance element is a fourth resistor.

In accordance with another embodiment, the first impedance element comprises a transistor having a control terminal, a first current carrying terminal, and a second current carrying terminal, the control terminal coupled to the output of the reference voltage generator circuit, and the first current carrying terminal coupled for receiving a third source of potential; and wherein the second impedance element comprises a first resistor having a first terminal coupled to the first current carrying terminal of the transistor.

In accordance with another embodiment, the third impedance element comprises a second resistor having a first terminal and a second terminal, the first terminal of the second resistor coupled to the output of the reference voltage generator circuit and a third resistor having a first terminal and a second terminal, the first terminal of the third resistor coupled to the second terminal of the second resistor, and the second terminal of the third resistor coupled for receiving the second source of potential.

In accordance with another embodiment, the first impedance element comprises a transistor having a control terminal, a first current carrying terminal, and a second current carrying terminal, wherein the control terminal is coupled to the output of the reference voltage generation circuit and the first current carrying terminal is coupled for receiving a third source of potential. The second impedance element comprises a current source having a first terminal coupled to the first current carrying terminal of the transistor.

In accordance with another embodiment, the third impedance element comprises a first resistor having a first terminal and a second terminal, the first terminal of the first resistor coupled to the output of the reference voltage generation circuit; and a second resistor having a first terminal and a second terminal, the first terminal of the second resistor coupled to the second terminal of the first resistor, and the second terminal of the second resistor coupled for receiving the second source of potential.

In accordance with another embodiment, the first impedance branch includes first impedance element having a temperature coefficient and the second impedance branch has a second impedance element that has a temperature coefficient, wherein the temperature coefficient of the first impedance element is different than a temperature coefficient of the second impedance element.

In accordance with another embodiment, a reference voltage temperature compensation circuit is provided that comprises a reference cell having an output, a first impedance element having a first terminal and a second terminal, wherein the first terminal of the first impedance element coupled to the output of the reference cell. The reference voltage temperature compensation circuit further includes a second impedance element having a first terminal and a second terminal, the first terminal of the second impedance element coupled to the output of the reference; and a conversion circuit having a first input, a second input, and an output, wherein the conversion circuit converts a voltage at its input into a current that appears at its output, and wherein the first input of the conversion circuit is coupled to second terminal of the first impedance element and the second input of the conversion circuit is coupled to the second terminal of the second impedance element.

FIG. 1 is a block diagram of a compensated reference voltage generation circuit 10 in accordance with an embodiment of the present invention. What is shown in FIG. 1 is a reference voltage generator circuit 12 coupled to compensation circuit 16. More particularly, reference voltage generator circuit 12 has an output 14 and compensation circuit 16 has an input 18 and an output 20, wherein output 14 of voltage generator circuit 12 is connected to input 18 of compensation circuit 16. Output 20 is connected to a load 21 through a diode 23. It should be noted that diode 23 is an optional circuit element that controls the direction in which an error current $I_{ERR}$ flows. Reference voltage generator circuit 12 may be referred to as a reference voltage generator, a reference cell, a reference generator. It may also be referred to as a bandgap reference or bandgap reference circuit in embodiments in which reference voltage $V_{REF}$ is generated by a bandgap reference circuit. Although reference voltage $V_{REF}$ is shown as being generated by a reference voltage generator circuit, this is not a limitation of the present invention. For example, reference voltage $V_{REF}$ may be generated by an external source such as, for example, a sensor output. Compensation circuit 16 may be referred to as a corrector circuit, a corrector cell, a corrector, a temperature coefficient corrector, or a temperature coefficient compensator, and generates an output voltage $V_{OUT}$ at output 20 that is similar to reference voltage $V_{REF}$ generated by reference voltage generator circuit 12, but that is compensated for variations caused by temperature changes. It should be noted that circuitry internal to compensation circuit 16 generates an error current that is injected into a resistor to create and error voltage that is added to voltage $V_{REF}$ to generate to generate output voltage $V_{OUT}$. The error current may be referred to as a compensation current and output voltage $V_{OUT}$ may be referred to as a corrected reference voltage or a compensated reference voltage $VC_{REF}$. Although compensation circuit 16 has been shown as having a single-ended output, this is not a limitation. Compensation circuit 16 can be configured to have a differential output.

Figure 2:
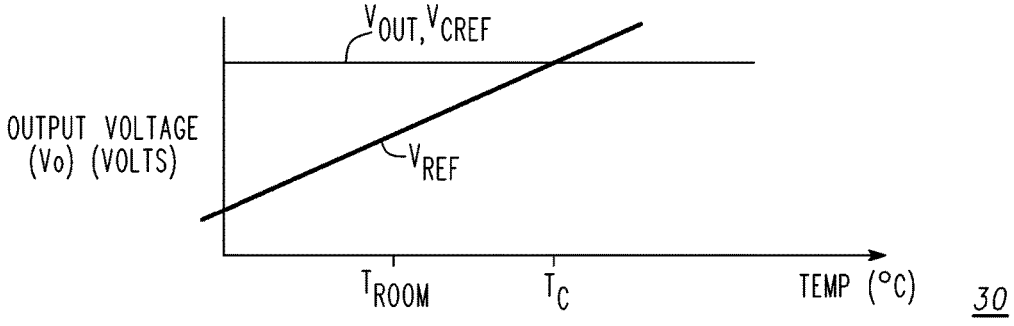
FIG. 2 is a plot of output voltage versus temperature in accordance with an embodiment of the present invention.

FIG. 2 is a plot 30 of output voltage versus temperature in accordance with an embodiment of the present invention. What is shown in FIG. 2 is reference voltage $V_{REF}$ versus temperature and a compensated reference voltage $VC_{REF}$ over temperature, wherein voltage is plotted along the ordinate and temperature is plotted along the abscissa. Compensated reference voltage $V_{CREF}$ may be referred to as output voltage $V_{OUT}$. It should be noted that at temperature $T_C$, the reference voltage $V_{REF}$ is substantially equal to output voltage $V_{OUT}$. At room temperature $T_{ROOM}$, reference voltage $V_{REF}$ is different than output voltage $V_{OUT}$. In FIG. 2, reference voltage $V_{REF}$ is shown as being less than output voltage $V_{OUT}$. Alternatively, reference voltage $V_{REF}$ may be greater than $V_{OUT}$ at room temperature $T_{ROOM}$. FIG. 2 illustrates an example in which output voltage $V_{OUT}$ has a temperature coefficient of zero, i.e., the output voltage remains constant over temperature. However, this is not a limitation of the present invention. For example, compensation circuit 16 can be configured such that output $V_{OUT}$ is generated that has a temperature coefficient that is a non-zero temperature coefficient.

Figure 3:
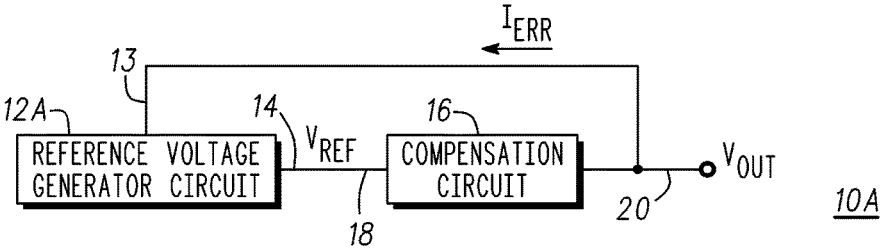
FIG. 3 is a block diagram of a semiconductor component that includes a compensation circuit coupled to a reference voltage generator in accordance with another embodiment of the present invention.

FIG. 3 is a block diagram of a compensated reference voltage generation circuit 10A in accordance with another embodiment of the present invention. What is shown in FIG. 3 is a reference voltage generator circuit 12A coupled to compensation circuit 16. More particularly, reference voltage generator circuit 12A has an input 13 and an output 14 and compensation circuit 16 has an input 18 and an output 20, wherein output 14 of voltage generator circuit 12A is connected to input 18 of compensation circuit 16. Output 20 is connected to input 13 of voltage generator circuit 12A so that an error current $I_{ERR}$ can be injected into input 13 of reference voltage generator circuit 12A. Like reference voltage generator circuit 12, reference voltage generator circuit 12A may be referred to as a reference voltage generator, a reference cell, a reference generator, or a bandgap reference or bandgap reference circuit in embodiments in which reference voltage $V_{REF}$ is generated by a bandgap reference circuit. Compensation circuit 16 generates output current $I_{ERR}$ that is injected into input 13 to generate an output voltage $V_{OUT}$ at output 20 that is compensated for variations caused by temperature changes. Compensation circuit 16 may be referred to as a corrector circuit, a corrector cell, a corrector, a temperature coefficient corrector, or a temperature coefficient compensator. Thus, output voltage $V_{OUT}$ may be referred to as a corrected reference voltage or a compensated reference voltage. Although compensation circuit 16 has been shown as having a single-ended output, this is not a limitation. Compensation circuit 16 can be configured to have a differential output.

Figure 4:
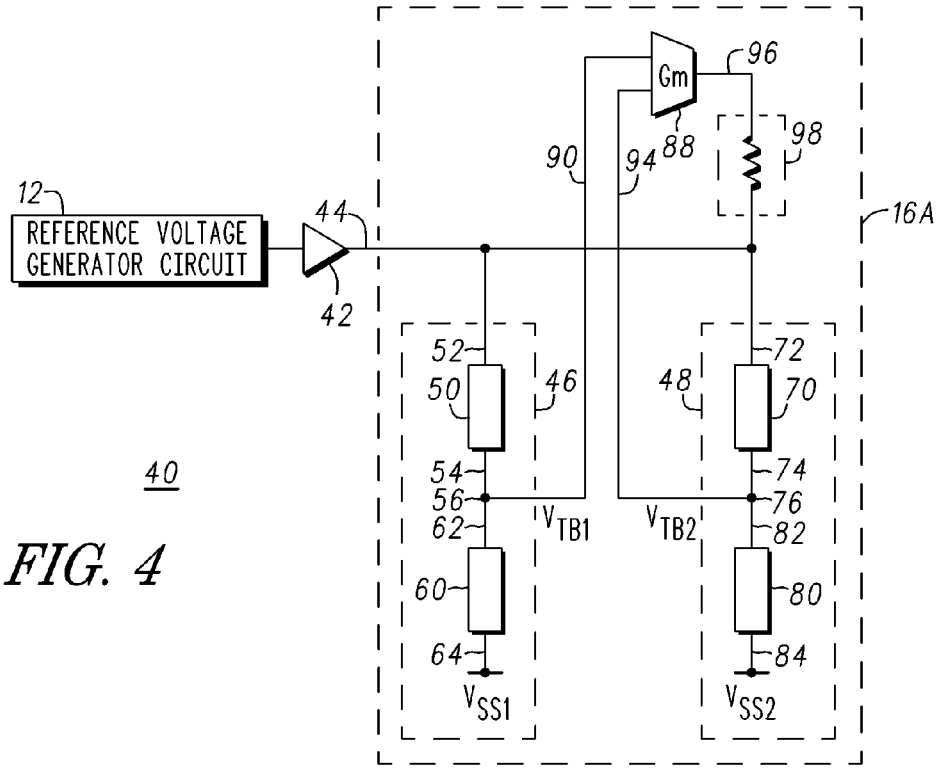
FIG. 4 is a circuit schematic of a semiconductor component that includes a compensation circuit coupled to a reference voltage generator in accordance with another embodiment of the present invention.

FIG. 4 is a circuit schematic of a compensated reference voltage generation circuit 40 in accordance with another embodiment of the present invention. Compensated reference voltage generation circuit 40 comprises reference voltage generator circuit 12 having an output coupled to a driver circuit 42. By way of example, driver circuit 42 is a unity gain buffer circuit, i.e., driver circuit 42 has a gain of one. Although driver circuit 42 is shown as being a separate circuit from reference voltage generator circuit 12 and having a unity gain, these are not limitations of the present invention. Driver circuit 42 may be a portion of or integrated with reference voltage generator circuit 12 and driver circuit 42 may have a gain other than one. A compensation circuit 16A is connected to an output terminal of unity gain buffer 42. It should be noted that for the sake of generality, the compensation circuit 16A is identified by reference character 16A, wherein the letter A has been appended to reference character 16 to indicate that compensation circuit 16A may be different from compensation circuit 16.

Compensation circuit 16A is comprised of an impedance network 46 connected to output 44 of unity gain driver 42 and an impedance network 48 connected to output 44 of unity gain driver 42. Impedance network 46 may be referred to as an impedance branch or an impedance path. Similarly, impedance network 48 may be referred to as an impedance branch or an impedance path. In accordance with an embodiment, impedance branch 46 includes an impedance element 50 connected to an impedance element 60, wherein impedance element 50 has a terminal 52 connected to output 44 of unity gain driver 42 and a terminal 54 connected to a terminal 62 of impedance element 60 to form a node 56. Node 56 may be referred to as a tap, a tap point, an impedance string output, an impedance string tap, an impedance string terminal, a ladder output, a ladder tap, a ladder terminal, or the like. Impedance element 60 has a terminal 64 coupled for receiving a source of potential such as, for example, potential $V_{SS1}$. By way of example source of potential $V_{SS1}$ is an operating potential such as ground. Impedance branch 48 includes an impedance element 70 connected to an impedance element 80, wherein impedance element 70 has a terminal 72 connected to output 44 of unity gain driver 42 and a terminal 74 connected to a terminal 82 of impedance element 80 to form a node 76. Like node 56, node 76 may be referred to as a tap, a tap point, an impedance string output, an impedance string tap, an impedance string terminal, a ladder output, a ladder tap, a ladder terminal, or the like. Impedance element 80 has a terminal 84 coupled for receiving a source of potential such as, for example, potential $V_{SS2}$. By way of example source of potential $V_{SS2}$ is an operating potential such as ground. Sources of potential $V_{SS1}$ and $V_{SS2}$ may be equal and referred to as sources of potential $V_{SS}$ or they may be different potentials from each other.

It should be noted that although impedance elements 50, 60, 70, and 80 are shown as being lumped impedances, they can each be comprised of a combination of impedances coupled together in series.

Impedance networks 46 and 48 are configured so that at least one of impedance elements 50, 60, 70, or 80 has a different temperature coefficient compared to the other impedance elements. For example, impedance element 50 has a different temperature coefficient compared to impedance elements 60, 70, and 80. Alternatively, impedance element 60 has a different temperature coefficient compared to impedance elements 50, 70, and 80; or impedance element 70 has a different temperature coefficient compared to impedance elements 50, 60, and 80; or impedance element 80 has a different temperature coefficient compared to impedance elements 50, 60, and 70; impedance elements 50 and 80 may have different temperature coefficients compared to impedance elements 60 and 70 etc. Thus, impedance networks 46 and 48 are configured to have different characteristics over temperature at nodes 56 and 76 to generate input signals for inputs 90 and 94 of transconductance circuit 88 described below.

Impedance network 46 generates a voltage $V_{TB1}$ at node 56 and impedance network 48 generates a voltage $V_{TB2}$ at node 76 in response to applying reference voltage $V_{REF}$ thereto, i.e., in response to applying reference voltage $V_{REF}$ to inputs 52 and 72 of impedance networks 46 and 48, respectively. Because the temperature coefficient of one of impedance elements 50, 60, 70, and 80 is different from those of the other impedance elements, voltage $V_{TB1}$ at node 56 is different from voltage $V_{TB2}$ at node 76 for temperatures other than, for example, temperature Tc shown in FIG. 2, i.e., the temperature at which reference voltage $V_{REF}$ is made to be substantially equal to the output voltage by trimming the value of one of the impedance elements. At temperature values other than the temperature at which the reference voltage equals the output voltage, voltages $V_{TB1}$ and $V_{TB2}$ at nodes 56 and 76 are different. It should be noted that the difference between voltage $V_{TB1}$ and $V_{TB2}$, i.e., $V_{TB1}-V_{TB2}$, may be positive or negative and that this difference can be used to determine whether temperature T is greater than temperature $T_C$, i.e., $T>T_C$, or whether temperature T is less than temperature $T_C$, i.e., $T<T_C$. The impedance values of impedances 50, 60, 70, 80 are trimmed or adjusted so that voltages $V_{TB1}$ and $V_{TB2}$ are equal to each other at a temperature $T_C$ at which output voltage $V_{OUT}$ and reference voltage $V_{REF}$ are equal.

Compensation circuit 16A further includes a transconductance circuit 88 that has an input 90, an input 94, an output 96, a tranconductance parameter Gm and that generates an error current $I_{ERR}$ in response to the input voltage across inputs 90 and 94. Transconductance circuit 88 may be referred to as a transconductance generation circuit or a conversion circuit and converts a voltage difference at inputs 90 and 94 into error current $I_{ERR}$, wherein the value of transconductance parameter Gm is set to make output voltage $V_{OUT}$ equal a target voltage for a temperature T that is less than temperature $T_C$ or that is greater than temperature $T_C$. It should be noted that determining the value of the impedance for which voltage $V_{TB1}$ equals voltage $V_{TB2}$ can be made more easily by increasing the value of transconductance parameter Gm. It should be further noted that transconductance parameter Gm may be a nonlinear parameter. Input 90 is connected to node 56, input 94 is connected to node 76, and output 96 is connected to a load 98 such as, for example, a load resistor. Load 98 has a terminal connected to output 96 and a terminal connected to output 44. In accordance with an embodiment, load 98 is a resistor and may be referred to as a load resistor or an output resistor. The temperature coefficient of load resistor 98 is not limited to a defined value, i.e., there are no restrictions on the temperature coefficient of load resistor 98. In accordance with an embodiment, inputs 90 and 94 may be referred to collectively as a differential input and output 96 may be referred to as a single ended output. In accordance with embodiments in which inputs 90 and 94 form a differential input, impedance networks 46 and 48 generate a differential voltage across nodes 56 and 76 that is applied to transconductance circuit 88. The voltage across inputs 90 and 94 changes over temperature due to the difference in temperature coefficient of the at least one of the impedances 50, 60, 70, and 80 and this change in voltage causes the error current to change proportionally with the transconductance Gm. The error current is injected into load 98 and generates an error voltage $V_{ERR}$ that matches the difference between reference voltage $V_{REF}$ and a target output voltage. Thus, error voltage $V_{ERR}$ is added to reference voltage $V_{REF}$ to produce an output voltage $V_{OUT}$ that matches the target voltage and remains substantially constant over temperature or that has a selected temperature coefficient that is different from zero. Output voltage $V_{OUT}$ that remains substantially constant over temperature may be referred to as a compensated reference voltage $V_{CREF}$ and error voltage $V_{ERR}$ may be referred to as an adjustment voltage $V_{ADJ}$. It should be noted that error current $I_{ERR}$ may be referred to as a compensation signal that is generated in response to voltages $V_{TB1}$ and $V_{TB2}$, which voltages may be a differential voltage. Alternatively, error voltage $V_{ERR}$ may be referred to a compensation signal that is generated in response to voltages $V_{TB1}$ and $V_{TB2}$ because error voltage $V_{ERR}$ is generated in response to error current $I_{ERR}$.

The method for adjusting reference voltage $V_{REF}$ using error current $I_{ERR}$ is not a limitation of the present invention. For example and as discussed with reference to FIG. 3, error current $I_{ERR}$ from transconductance circuit 88 may be injected into an internal node of reference voltage generator circuit 12 to adjust voltage $V_{REF}$. Thus, in embodiments in which reference voltage generator 12 is a bandgap reference circuit, error current $I_{ERR}$ is injected into bandgap reference circuit 12. In addition, current $I_{ERR}$ generated by transconductance circuit 88 may be directed to flow so that it flows through load 98 in a single direction or in multiple directions. Directing current flow in a single direction may be accomplished by placing, for example, a diode 23 as shown in FIG. 1, between transconductance circuit 96 and load 98, such that the anode of diode 23 is connected to output 96 and the cathode of diode 23 is connected to load 98. It should be appreciated that diode 23 is an optional circuit element.

Figure 5:
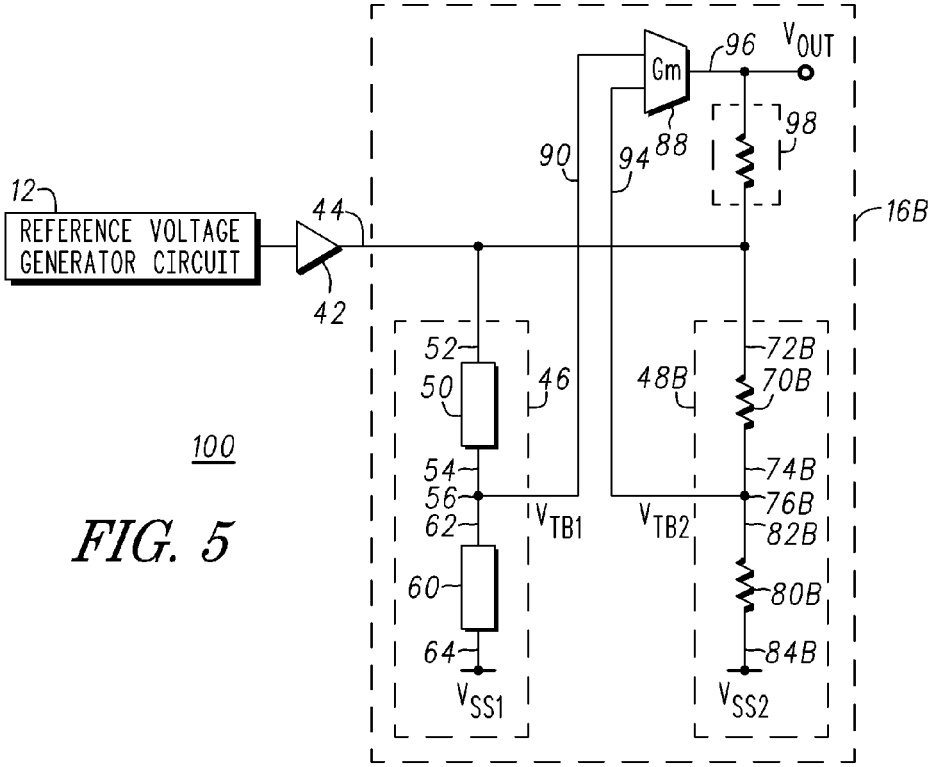
FIG. 5 is a circuit schematic of a semiconductor component that includes a compensation circuit coupled to a reference voltage generator in accordance with another embodiment of the present invention.

FIG. 5 is a circuit schematic of a compensated reference voltage generation circuit 100 in accordance with another embodiment of the present invention. Compensated reference voltage generation circuit 100 is similar to compensated reference voltage generation circuit 40 except that impedance network 48 has been replaced with an impedance network 48B, wherein impedance elements 70 and 80 have been replaced by resistors 70B and 80B. Thus, impedance network 40B may be referred to as a resistor branch, a resistor path, or a resistive divider. The reference character B has been appended to reference characters 70 and 80 of reference voltage compensation circuit 100 to distinguish resistors 70B and 80B, which are a type of impedance element from impedance elements 70 and 80, respectively. Impedance network 48B includes a resistor 70B connected to resistor 80B, wherein resistor 70B has a terminal 72B connected to output 44 of unity gain driver 42 and a terminal 74B connected to a terminal 82B of impedance element 80B to form a node 76B. Like nodes 56 and 76, node 76B may be referred to as a tap, a tap point, an impedance string output, an impedance string tap, an impedance string terminal, a ladder output, a ladder tap, a ladder terminal, or the like. Impedance element 80B has a terminal 84B coupled for receiving a source of potential such as, for example, potential $V_{SS2}$. By way of example source of potential $V_{SS2}$ is an operating potential such as ground. Sources of potential $V_{SS1}$ and $V_{SS2}$ may be equal and referred to as sources of potential $V_{SS}$ or they may be different potentials from each other. Compensation circuit 16B of voltage compensation circuit 100 has been identified with reference character 16A to distinguish it from compensation circuit 16 of voltage compensation circuit 40.

Figure 6:
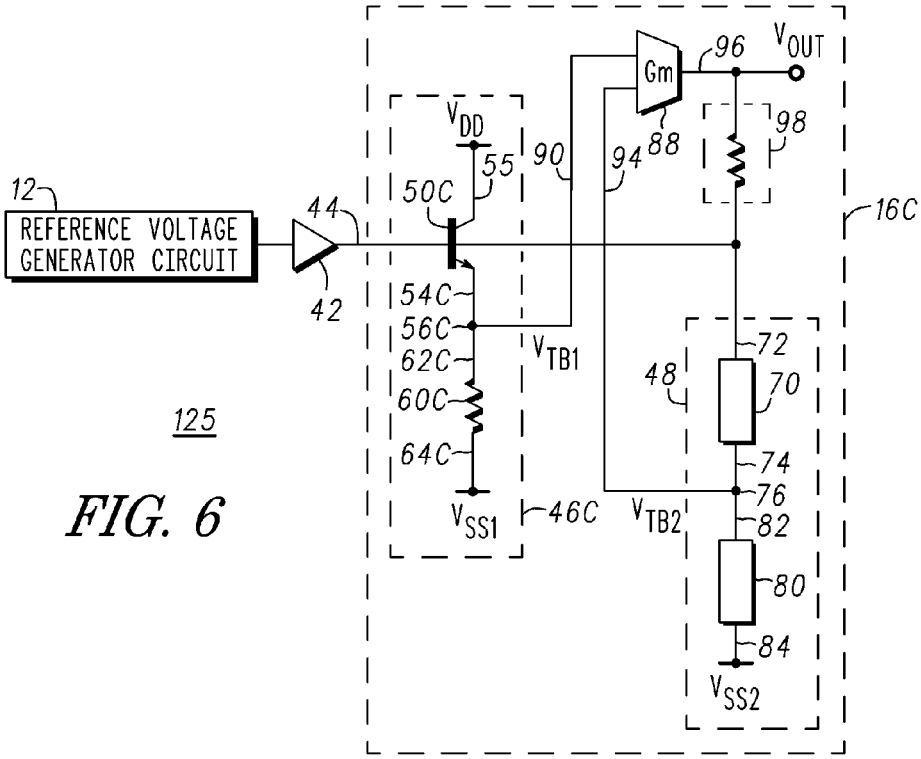
FIG. 6 is a circuit schematic of a semiconductor component that includes a compensation circuit coupled to a reference voltage generator in accordance with another embodiment of the present invention.

FIG. 6 is a circuit schematic of a compensated reference voltage generation circuit 125 in accordance with another embodiment of the present invention. Compensated reference voltage generation circuit 125 is similar to compensated reference voltage generation circuit 40 except that impedance network 46 has been replaced with an impedance network 46C, which may be referred to as an impedance branch or an impedance path. Impedance elements 50 and 60 have been replaced by transistor 50C and a resistor 60C. The reference character C has been appended to reference characters 50 and 60 of reference voltage compensation circuit 125 to distinguish the impedance elements 50 and 60 from transistors 50C and 60C, respectively, which are a type of impedance element. Impedance network 46C includes transistor 50C connected to resistor 60C, wherein transistor 50C has a current carrying terminal 55 coupled for receiving a source of operating potential $V_{DD}$, a control terminal connected to output 44 of unity gain driver 42, and a current carrying terminal 54C connected to a terminal 62C of impedance element 60C to form a node 56C. Like nodes 56, 76, and 76B, node 56C may be referred to as a tap, a tap point, an impedance string output, an impedance string tap, an impedance string terminal, a ladder output, a ladder tap, a ladder terminal, or the like. Resistor 60C has a terminal 64C coupled for receiving a source of potential such as, for example, potential $V_{SS1}$. By way of example source of potential $V_{SS1}$ is an operating potential such as ground. Sources of potential $V_{SS1}$ and $V_{SS2}$ may be equal and referred to as sources of potential $V_{SS}$ or they may be different potentials from each other. Compensation circuit 16C of voltage compensation circuit 125 has been identified with reference character 16C to distinguish it from compensation circuits 16A and 16B of voltage compensation circuits 40 and 100, respectively.

Figure 7:
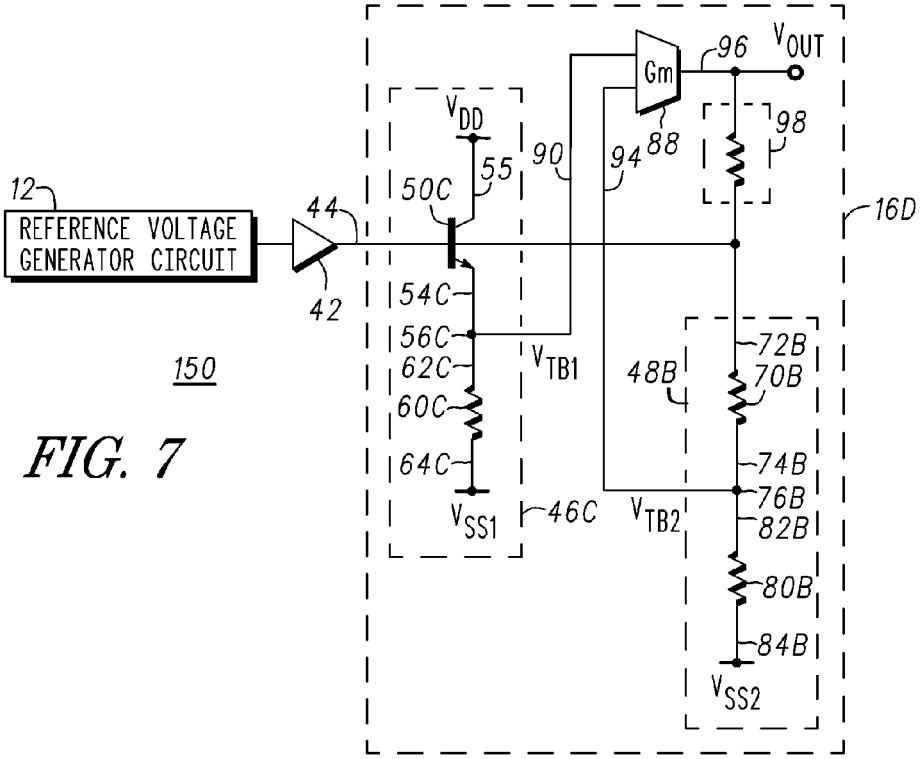
FIG. 7 is a circuit schematic of a semiconductor component that includes a compensation circuit coupled to a reference voltage generator in accordance with another embodiment of the present invention.

FIG. 7 is a circuit schematic of a compensated reference voltage generation circuit 150 in accordance with another embodiment of the present invention. Compensated reference voltage generation circuit 150 is similar to compensated reference voltage generation circuit 125 except that impedance network 48 has been replaced with an impedance network 48B, which may be referred to as a resistor branch or a resistor path. Impedance elements 70 and 80 have been replaced by resistors 70B and 80B, respectively, which resistors have been described with reference to FIG. 6. The reference character C has been replaced by reference character D of compensation circuit 16C to distinguish compensation circuit 16D from compensation circuit 16C. Impedance network 46C includes transistor 50C connected to resistor 60C, wherein transistor 50C has a current carrying terminal 55 coupled for receiving a source of operating potential $V_{DD}$, a control terminal connected to output 44 of unity gain driver 42, and a current carrying terminal 54C connected to a terminal 62C of impedance element 60C to form node 56C. Resistor 60C has a terminal 64C coupled for receiving a source of potential such as, for example, potential $V_{SS1}$. By way of example source of potential $V_{SS1}$ is an operating potential such as ground. Sources of potential $V_{SS1}$ and $V_{SS2}$ may be equal and referred to as sources of potential $V_{SS}$. Compensation circuit 16D of voltage compensation circuit 150 has been identified with reference character 16D to distinguish it from compensation circuits 16A, 16B, and 16C of voltage compensation circuits 40, 100, and 125, respectively.

Figure 8:
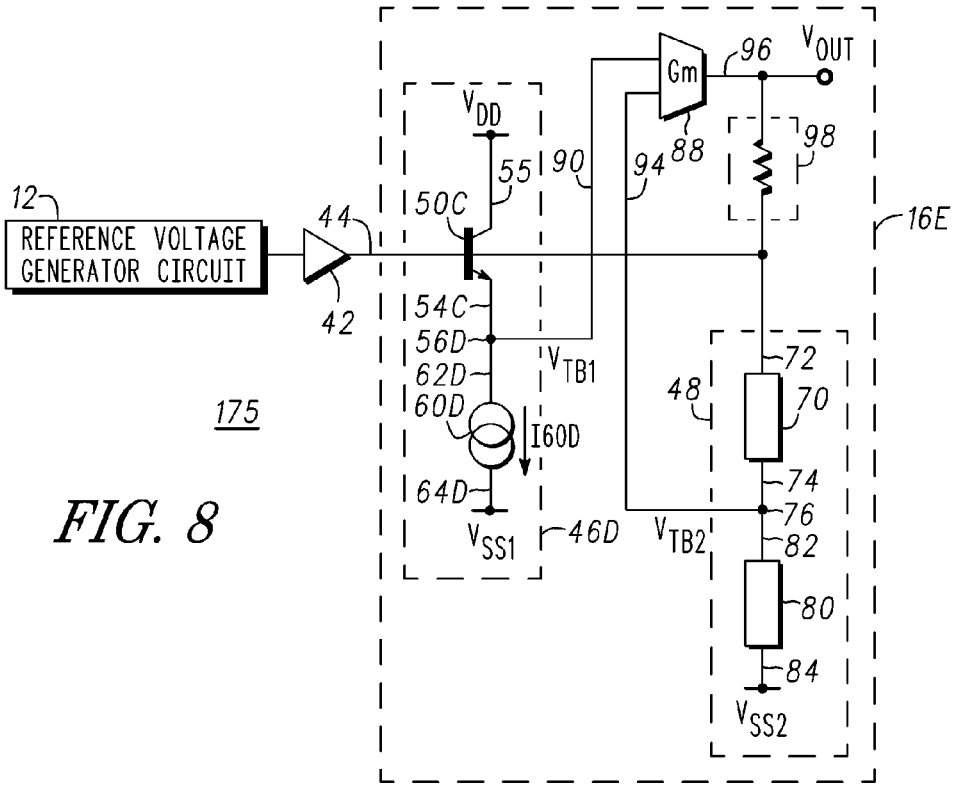
FIG. 8 is a circuit schematic of a semiconductor component that includes a compensation circuit coupled to a reference voltage generator in accordance with another embodiment of the present invention.

FIG. 8 is a circuit schematic of a compensated reference voltage generation circuit 175 in accordance with another embodiment of the present invention. Compensated reference voltage generation circuit 175 is similar to compensated reference voltage generation circuit 125 except that resistor 60C has been replaced with current source 60D, which may be part of an impedance branch or an impedance path. The reference character C has been replaced by reference character D in compensation circuit 16E to distinguish compensation circuit 16E from compensation circuit 16D. Impedance network 46D includes a current source 60D connected to a current carrying terminal 54C of transistor 50C to form a node 56D. Like nodes 56, 76, 76B, and 56C, node 56D may be referred to as a tap, a tap point, an impedance string output, an impedance string tap, an emitter follower output in embodiments in which a bipolar junction transistor forms node 56D, a source follower output in embodiments in which a field effect transistor forms node 56D, or the like. Current source 60 has a terminal 64D coupled for receiving a source of potential such as, for example, potential $V_{SS1}$ and conducts a current 160D. By way of example source of potential $V_{SS1}$ is an operating potential such as ground. Alternatively, source of potential $V_{SS1}$ can be a potential that allows current source 60D to conduct a current $I_{60D}$. Sources of potential $V_{SS1}$ and $V_{SS2}$ may be equal and referred to as sources of potential $V_{SS}$ or they may be different potentials from each other. Compensation circuit 16E of voltage compensation circuit 175 has been identified with reference character 16E to distinguish it from compensation circuits 16A, 16B, 16C, and 16D of voltage compensation circuits 40, 100, 125, and 150, respectively.

Figure 9:
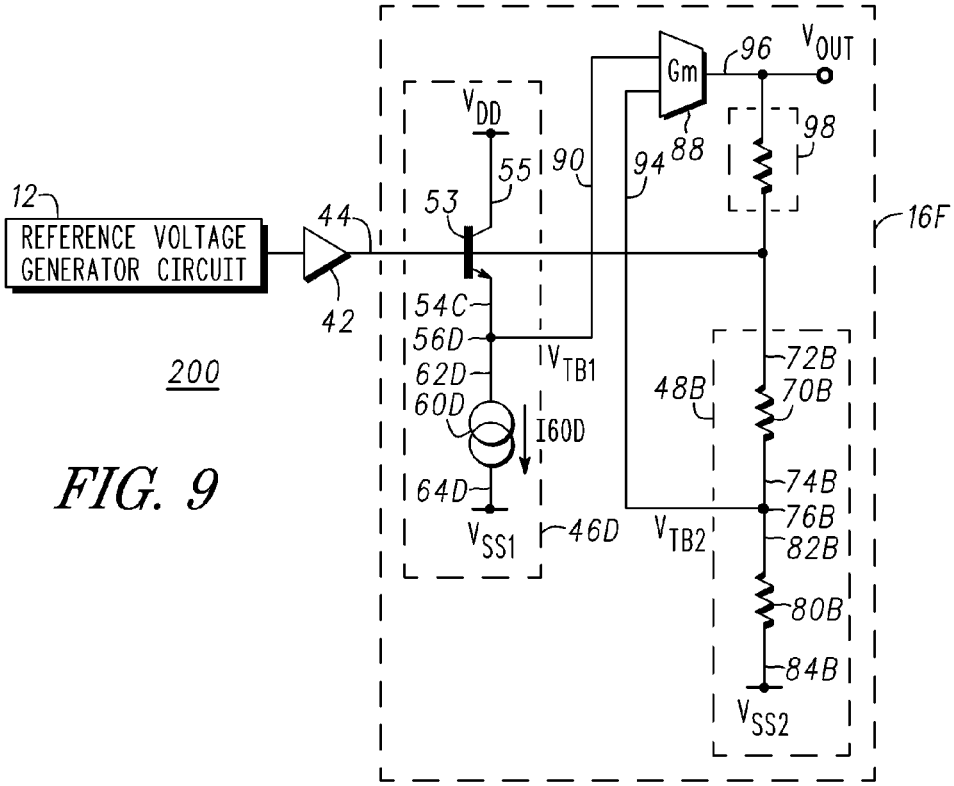
FIG. 9 is a circuit schematic of a semiconductor component that includes a compensation circuit coupled to a reference voltage generator in accordance with another embodiment of the present invention.

FIG. 9 is a circuit schematic of a compensated reference voltage generation circuit 200 in accordance with another embodiment of the present invention. Compensated reference voltage generation circuit 200 is similar to compensated reference voltage generation circuit 175 except that impedance elements 70 and 80 have been replaced with resistors 70B and 80B, respectively, described with reference to FIG. 5. Thus, the compensation circuit has been identified by reference character 16F. Compensation circuit 16F of voltage compensation circuit 200 has been identified with reference character 16F to distinguish it from compensation circuits 16A, 16B, 16C, 16D, and 16E of voltage compensation circuits 40, 100, 125, 150, and 175, respectively.

Figure 10:
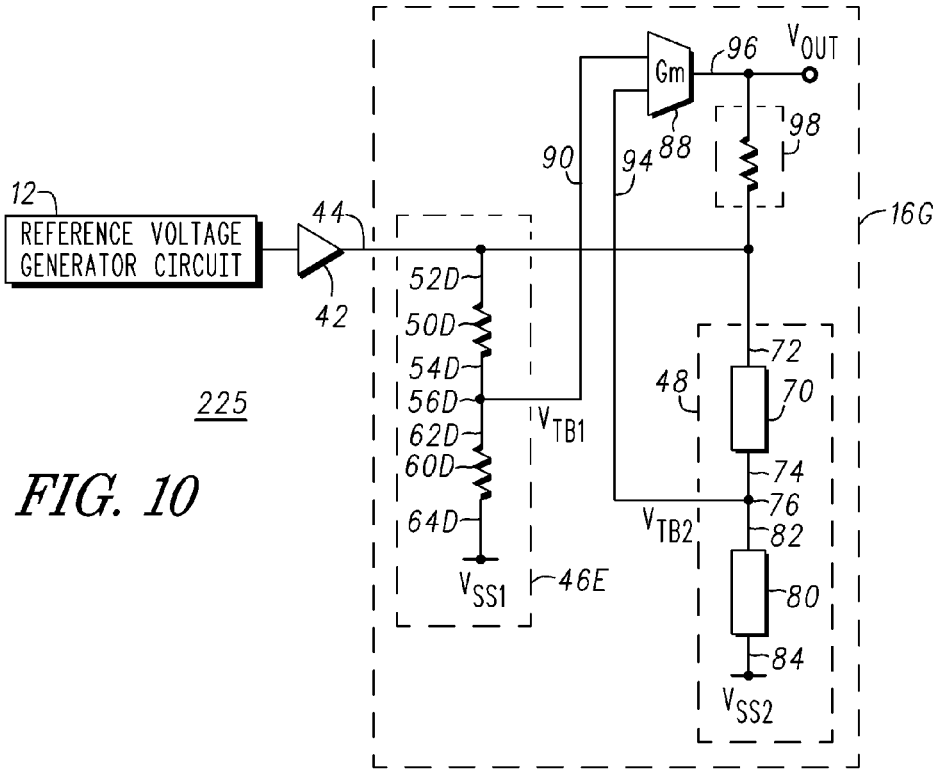
FIG. 10 is a circuit schematic of a semiconductor component that includes a compensation circuit coupled to a reference voltage generator in accordance with another embodiment of the present invention.

FIG. 10 is a circuit schematic of a compensated reference voltage generation circuit 225 in accordance with another embodiment of the present invention. Compensated reference voltage generation circuit 225 is similar to compensated reference voltage generation circuit 125 except that impedance elements 50C and 60C have been replaced with resistors 50D and 60D, respectively. Thus, the compensation circuit has been identified by reference character 16G. Impedance network 46E includes a resistor 50D connected to resistor 60D, wherein resistor 50D has a terminal 52D connected to output 44 of unity gain driver 42 and a terminal 54D connected to a terminal 62D of impedance element 60D to form a node 56D. Node 56D may be referred to as a tap, a tap point, a resistive divider output, or the like. Impedance element 60D has a terminal 64D coupled for receiving a source of potential such as, for example, potential $V_{SS1}$. By way of example source of potential $V_{SS}$ is an operating potential such as ground. Sources of potential $V_{SS1}$ and $V_{SS2}$ may be equal and referred to as sources of potential $V_{SS}$ or they may be different potentials from each other. Compensation circuit 16G of voltage compensation circuit 225 has been identified with reference character 16G to distinguish it from compensation circuits 16A, 16B, 16C, 16D, 16E, and 16F of voltage compensation circuits 40, 100, 125, 150, 175, and 200, respectively.

Figure 11:
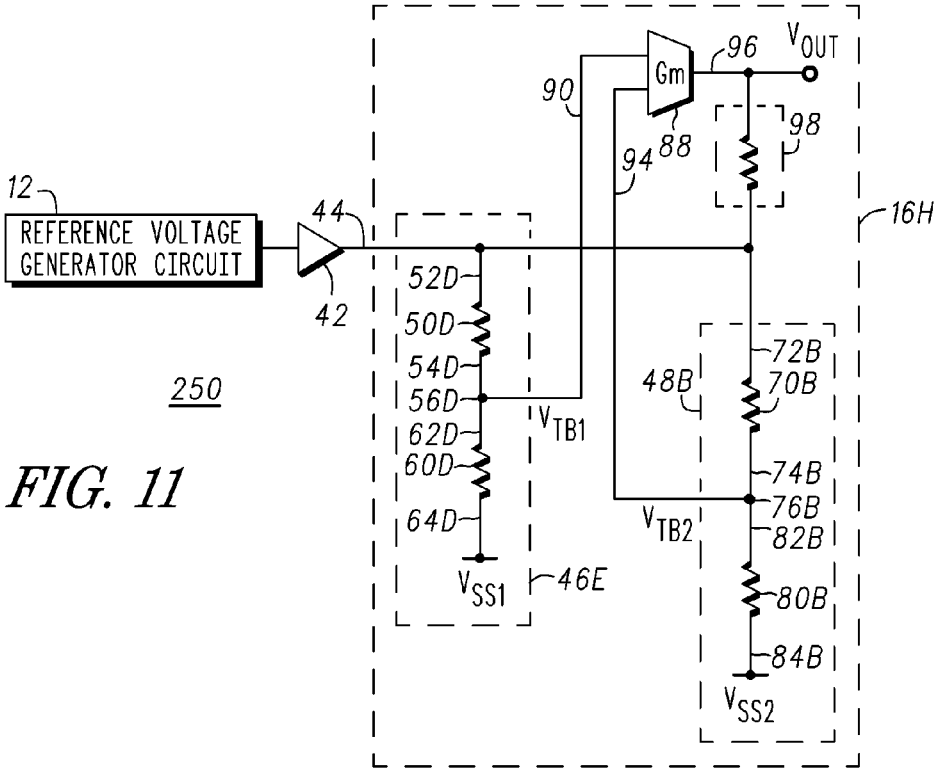
FIG. 11 is a circuit schematic of a semiconductor component that includes a compensation circuit coupled to a reference voltage generator in accordance with another embodiment of the present invention.

FIG. 11 is a circuit schematic of a compensated reference voltage generation circuit 250 in accordance with another embodiment of the present invention. Compensated reference voltage generation circuit 250 is similar to compensated reference voltage generation circuit 225 except that impedance network 48 has been replaced by impedance network 48B described with reference to FIG. 5. Thus, the compensation circuit has been identified by reference character 16H. Compensation circuit 16H of voltage compensation circuit 250 has been identified with reference character 16H to distinguish it from compensation circuits 16A, 16B, 16C, 16D, 16E, 16F, and 16G of voltage compensation circuits 40, 100, 125, 150, 175, 200, and 225, respectively.

Figure 12:
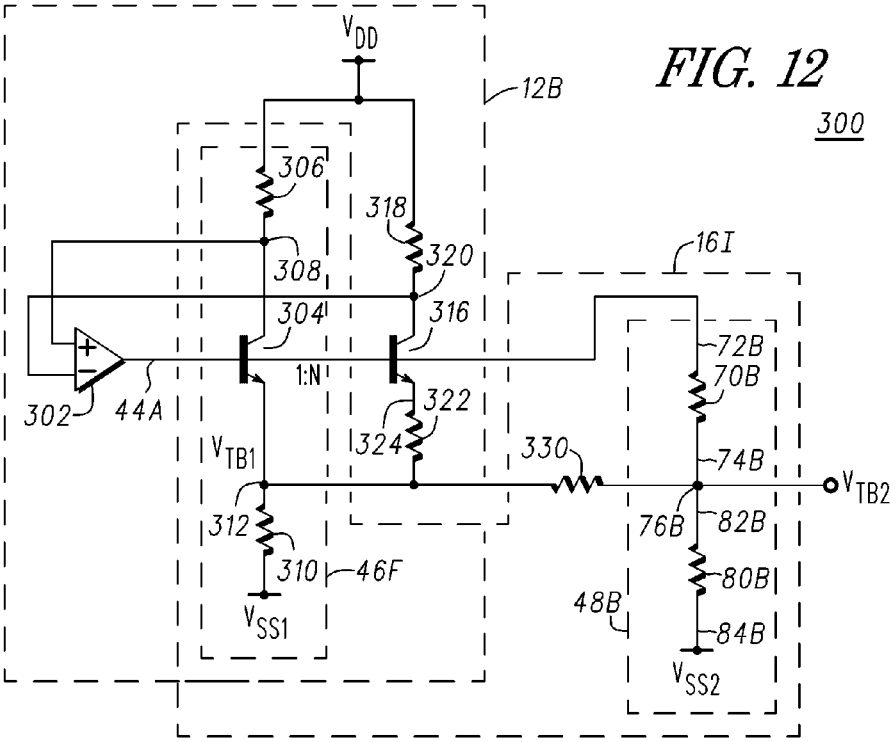
FIG. 12 is a circuit schematic of a semiconductor component that includes a compensation circuit coupled to a reference voltage generator in accordance with another embodiment of the present invention.

FIG. 12 is a circuit schematic of a compensated reference voltage generation circuit 300 in accordance with another embodiment of the present invention. Compensated reference voltage generation circuit 300 comprises a bandgap circuit or a bandgap reference circuit 12B having an output 44A. A compensation circuit 16I is connected to output terminal 44A of reference voltage generator circuit 12B. In accordance with an embodiment, reference voltage generator circuit 12B includes an amplifier 302 having an inverting input, a noninverting input, and an output that serves as output 44A. It should be noted that in accordance with an embodiment, a unity gain drive circuit such as, for example, unity gain drive circuit 42 is included in amplifier 302 and provides the current to bias resistors 70B and 80B and any other devices connected to its output. A transistor 304 having a base, a collector, and an emitter is connected to reference voltage generator circuit 12B. More particularly, the base of transistor 304 is connected to output 44A, the collector of transistor 304 is connected to a terminal of a resistor 306 to form a node 308. The other terminal of resistor 306 is coupled for receiving a source of potential $V_{DD}$. Alternatively, the other terminal of resistor 306 may be coupled for receiving a voltage generated by another source of potential. The emitter of transistor 304 is connected to a terminal of a resistor 310 to form a node 312 and the other terminal of resistor 310 is coupled for receiving a source of potential $V_{SS1}$. Reference voltage generator circuit 12B further includes a transistor 316 having a base, a collector, and an emitter, wherein the base of transistor 316 is connected to output 44A, the collector is connected to a terminal of a resistor 318 to form a node 320, and the emitter is connected to a terminal of a resistor 322 to form a node 324. The other terminal of resistor 318 is coupled for receiving source of operating potential $V_{DD}$ and the other terminal of resistor 322 is connected to node 312. The noninverting input of amplifier 302 is connected to node 308 and the inverting input of amplifier 302 is connected to node 320. Although transistors 304 and 316 have been described as being bipolar transistors, this is not a limitation of the present invention. Transistors 304 and 316 may be field effect transistors, or the like. The base of a bipolar transistor and the gate of a field effect transistor may be referred to as control terminals, the collector of a bipolar transistor, the drain of a field effect transistor, the emitter of a bipolar transistor, and the source of a field effect transistor may be referred to as current carrying terminals. In addition, the base of a bipolar transistor may be referred to as a base terminal or a base electrode, the collector of a bipolar transistor may be referred to as a collector terminal or a collector electrode, and the emitter of a bipolar transistor may be referred to as an emitter terminal or an emitter electrode. It should be noted that the topology of bandgap reference circuit 12B is not a limitation of the present invention and that the bandgap reference circuit provides a voltage at node 312 and the resistive divider 48B provides a voltage at node 76B that are different functions of temperature.

Compensation circuit 16I includes an impedance network 46F connected to output 44A and an impedance network 48B connected to output 44A. Impedance network 48B has been described with reference to FIG. 4. Impedance network 46F includes transistor 304, resistor 306 having a terminal coupled for receiving source of potential $V_{DD}$ and resistor 310 having a terminal coupled for receiving source of potential $V_{SS}$. Compensation circuit 16I further includes a resistor 330 having a terminal connected to node 312 and a terminal connected to node 76B, wherein resistor 330 serves as a transconductance circuit that provides a transconductance Gm. Thus, resistor 330 injects a current into an internal node of reference circuit 12B that adjusts or compensates for the temperature changes in reference voltage $V_{REF}$. In accordance with embodiments in which a differential error current $I_{ERR}$ is injected from resistor 330, impedance networks 46F and 48B generate a differential voltage across nodes 312 and 76B. Impedance networks 46F and 48B are configured so that at least one of impedance elements 304, 310, 70B, or 80B has a different temperature coefficient compared to the other three impedance elements.

In operation, reference voltage generator circuit 12B is configured to generate a band gap reference at output 44A. Compensation circuit 16I generates a voltage $V_{TB1}$ at node 312 from the bandgap reference voltage at output 44A and a voltage $V_{TB2}$ at node 76B, wherein voltage $V_{TB2}$ is a fraction of the bandgap reference voltage at output 44A. Transistors 304 and 316 have an emitter area ratio of 1:N, where N is an integer, i.e., the emitter area of transistor 316 is N times larger than the emitter area of transistor 304. By way of example, N is equal to 8. The bases of transistors 304 and 316 are regulated to have a bandgap voltage of approximately 1.2 volts and resistors 70B and 80B to have temperature coefficients that are substantially equal to each other. Reference voltage generator circuit 12B is heated to a temperature $T_C$ and resistors 306 and 318 are trimmed to set voltages $V_{TB1}$ and $V_{TB2}$ to be substantially equal to each other. Reference voltage generator circuit 12B is heated to a temperature $T_{TAR}$ and resistor 330 is trimmed to set the reference voltage $V_{REF}$ at the target value. It should be noted that setting voltages $V_{TB1}$ and $V_{TB2}$ is not limited to trimming resistors 306 and 318. Alternatively, impedance element 70B and impedance element 80B may be trimmed or impedance element 70B or impedance element 80B may be trimmed.

Figure 13:
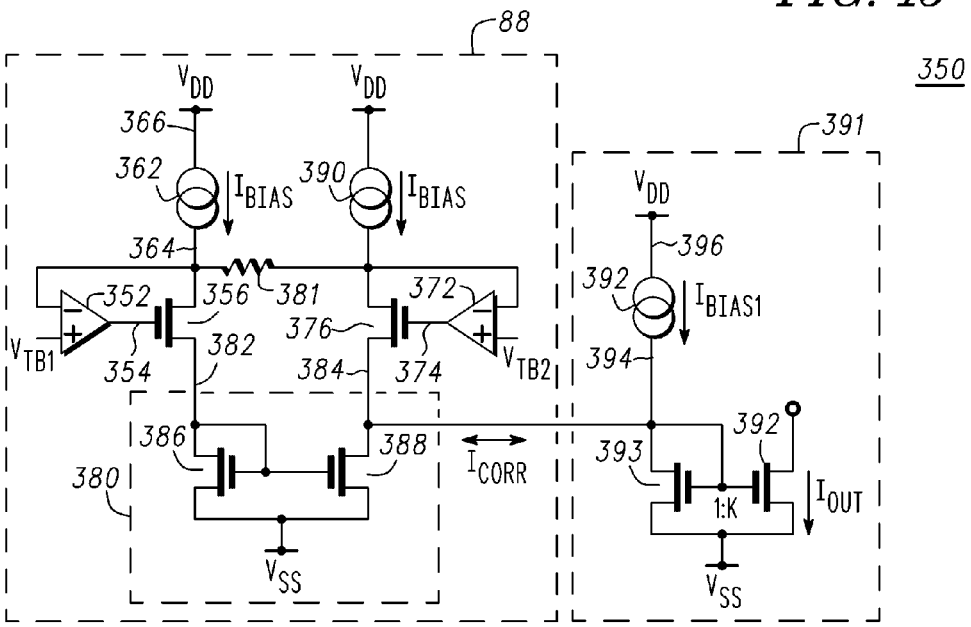
FIG. 13 is a circuit schematic of a semiconductor component that includes a compensation circuit coupled to a reference voltage generator in accordance with another embodiment of the present invention.

FIG. 13 is a circuit schematic of a transconductance circuit 88 in accordance with an embodiment of the present invention. What is shown in FIG. 13 is transconductance circuit 88 coupled to a current bias circuit 391. Transconductance circuit 88 includes an amplifier 352 connected to a transistor 356, wherein amplifier 352 has an inverting input, a noninverting input, and an output 354 and transistor 356 has a gate terminal, a drain terminal and a source terminal. By way of example, transistor 356 is a p-channel device or a p-channel transistor such as, for example a PMOS device. More particularly, the gate terminal of transistor 356 is connected to output 354 of amplifier 352, the source terminal of transistor 356 is connected to the inverting input of amplifier 352 and to a terminal 364 of a current source 362, which current source 362 has another terminal 366 coupled for receiving a source of potential $V_{DD}$. The noninverting input of amplifier 352 is coupled for receiving voltage $V_{TB1}$. A resistor 381 has a terminal connected to the source of transistor 356 and a terminal connected to the source of transistor 376. The drain of transistor 356 is connected to a terminal 382 of a current mirror 380. Transconductance circuit 88 further includes an amplifier 372 connected to a transistor 376, wherein amplifier 372 has an inverting input, a noninverting input, and an output 374 and transistor 376 has a gate terminal, a drain terminal and a source terminal. By way of example, transistor 376 is a p-channel device or a p-channel transistor such as, for example a PMOS device. More particularly, the gate terminal of transistor 376 is connected to output 374 of amplifier 372, the source terminal of transistor 376 is connected to the inverting input of amplifier 372 and to a terminal of a current source 390, which current source 390 has another terminal coupled for receiving potential $V_{DD}$. The noninverting input of amplifier 372 is coupled for receiving voltage $V_{TB2}$. The drain of transistor 376 is connected to a terminal 384 of current mirror 380. In accordance with this embodiment, the voltage difference between the noninverting inputs of amplifiers 352 and 372 is copied across or applied across resistor 381.

In accordance with an embodiment, current mirror 380 includes transistors 386 and 388, wherein the gates of transistors 386 and 388 are commonly connected together and to the drain of transistor 386. Current source circuit 391 includes a pair of transistors 392 and 393, wherein the bases of transistors 392 and 393 (or gates in embodiments in which transistors 392 and 393 are field effect transistors) are commonly connected together and to the drain of transistor 388. The drain of transistor 393 is connected to a terminal 394 of a current source 392, which current source 392 has a terminal 396 coupled for receiving source of potential $V_{DD}$. The sources of transistors 393 and 392 are commonly coupled together and for receiving a source of potential $V_{SS}$. By way of example, potential $V_{SS}$ is a ground potential. The drain of transistor 392 serves as an output terminal of current source 391. It should be noted that the configuration of current source circuit 391 is not a limitation of the present invention and that other suitable configurations for a current source circuit may be used.

In operation, voltages such as, for example, voltages $V_{TB1}$ and $V_{TB2}$ are trimmed so that voltage $V_{TB1}$ equals voltage $V_{TB2}$ and current $I_{BIAS1}$ is trimmed so that output current $I_{OUT}$ equals a target value $I_{TARGET}$ to set a temperature T that is equal to temperature $T_C$. For a temperature T that is less than temperature $T_C$ or a temperature T that is greater than temperature $T_C$, transconductance parameter Gm of transconductance circuit is trimmed so that current $I_{OUT}$ equals current $I_{BIAS1}$+current $I_{CORR}$, which current sum equals the target current $I_{TARGET}$, i.e., $I_{OUT}=I_{BIAS1}+I_{CORR}=I_{TARGET}$. In response to voltages $V_{TB1}$ and $V_{TB2}$ being input to the noninverting inputs to amplifiers 352 and 372, respectively, the transconductance value of transconductance circuit 88 is equal to the reciprocal of the resistance value of resistor 381 and a correction current Icorr is injected to and from the gates of transistors 392 and 393. Correction current Icorr is added to a current source input bias current $I_{BIAS1}$ to generate a target current $I_{OUT}$ at the drain of transistor 392, i.e., at the output of transconductance circuit 88.

The trimming of voltages $V_{TB1}$ and $V_{TB2}$ may be accomplished by trimming the impedance elements of impedance networks from which voltages $V_{TB1}$ and $V_{TB2}$ are generated at temperature $T_C$. Transconductance value Gm is selected by trimming current $I_{OUT}$ to target value $I_{TARGET}$ at a temperature that is different from temperature TC. The direction of current flow, which is indicated by the sign of the current Icorr, can be set by, for example, the choice of voltages $V_{TB1}$ or $V_{TB2}$ at the noninverting inputs of amplifiers 352 and 372. Current $I_{CORR}$ flows in one direction in response to voltage $V_{TB1}$ being at the noninverting input of amplifier 352 and voltage $V_{TB2}$ being at the noninverting input of amplifier 372 and current $I_{CORR}$ flows in the opposite direction in response to voltage $V_{TB2}$ being at the noninverting input of amplifier 352 and voltage $V_{TB1}$ being at the noninverting input of amplifier 372. Thus, voltages $V_{TB1}$ and $V_{TB2}$ are set equal to each other by trimming at temperature $T_C$. To trim voltage $V_{TB1}$ or $V_{TB2}$ at a temperature other than $T_C$ the value of transconductance parameter Gm is trimmed and the sign of current $I_{CORR}$ is selected to adjust output current $I_{OUT}$ back to or to be equal to current $I_{TARGET}$. It should be noted that the noninverting inputs of amplifiers 352 and 372 correspond to inputs 90 and 94, respectively, of transconductance circuits 88 of FIGS. 4, 5, 6, 7, 8, 9, 10, and 11.

FIG. 14 is a circuit schematic of a compensated reference voltage generation circuit 40A in accordance with another embodiment of the present invention. Compensated reference voltage generation circuit 40A comprises reference voltage generator circuit 12 having an output coupled to a driver circuit 42. By way of example, driver circuit 42 is a unity gain buffer circuit, i.e., driver circuit 42 has a gain of one. Although driver circuit 42 is shown as being a separate circuit from reference voltage generator circuit 12 and having a unity gain, these are not limitations of the present invention. Driver circuit 42 may be a portion of or integrated with reference voltage generator circuit 12 and driver circuit 42 may have a gain other than one. A compensation circuit 16A1 is connected to an output terminal 44 of unity gain buffer 42. It should be noted that for the sake of generality, compensation circuit 16A1 is identified by reference character 16A1, wherein the reference character A1 has been appended to reference character 16 to indicate that compensation circuit 16A1 may be different from compensation circuit 16 or compensation circuit 16A shown in FIGS. 1 and 4, respectively.

Compensation circuit 16A1 is comprised of an impedance network 46 connected to output 44 of unity gain driver 42, an impedance network 48 connected to output 44 of unity gain driver 42, a transconductance circuit 88A connected to impedance networks 46 and 48, and a transconductance circuit 88B connected to impedance networks 46 and 48. Impedance networks 46 and 48 have been described with reference to FIG. 4. Transconductance circuit 88A is similar to transconductance circuit 88 and has a transconductance parameter Gm1. Transconductance circuit 88B has a transconductance parameter Gm2 and is coupled to transconductance circuit 88A and to impedance networks 46 and 48. Like transconductance circuit 88A, transconductance circuit 88B has a noninverting input, an inverting input, and an output, wherein the noninverting input of transconductance circuit 88B is connected to the inverting input of transconductance circuit 88A, the inverting input of transconductance circuit 88B is connected to the noninverting input of transconductance circuit 88A, and the output is connected to the anode of a current limiting diode D2. Current limiting diode D2 has a cathode connected to the cathode of a current limiting diode D1 and to load 98. Current limiting diode D1 has an anode connected to the output of transconductance circuit 88.

It should be noted that although impedance elements 50, 60, 70, and 80 are shown as being lumped impedances, they can each be comprised of a combination of impedances coupled together in series.

Figure 15:
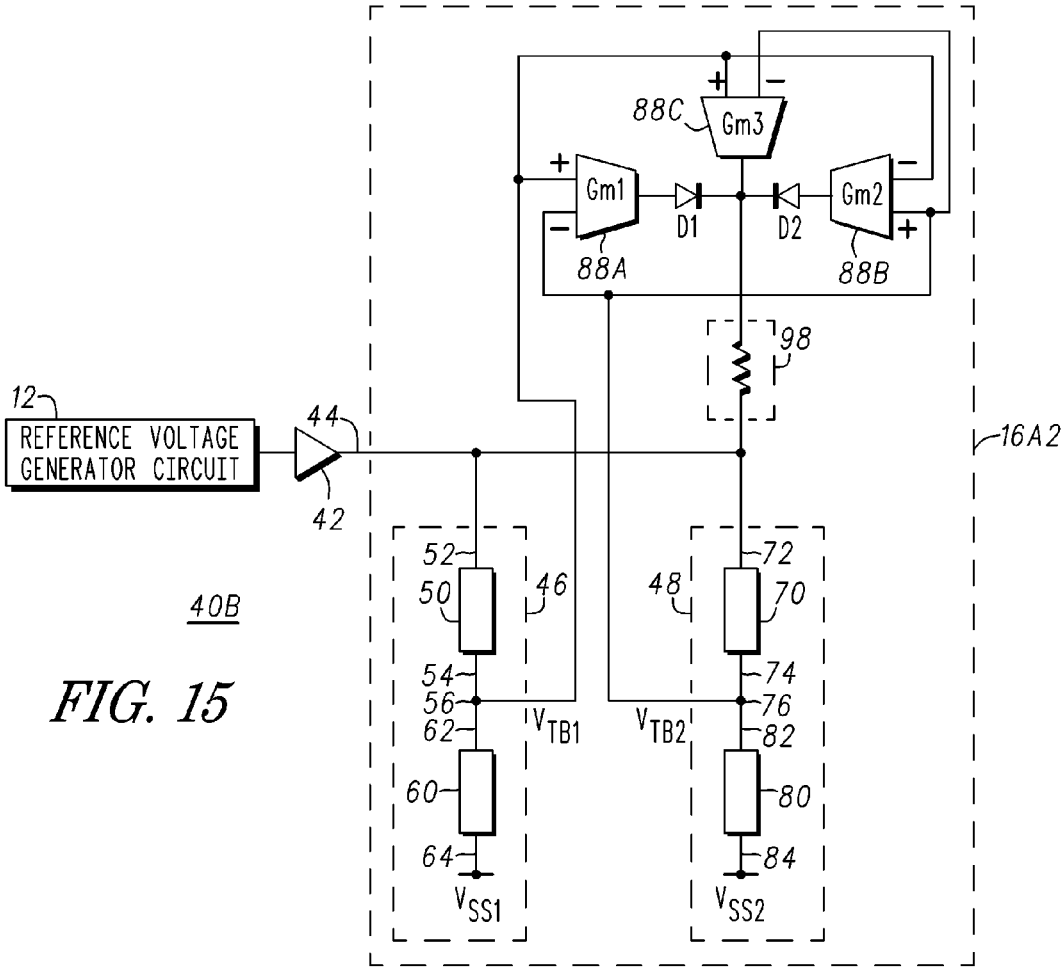
FIG. 15 is a circuit schematic of a semiconductor component that includes a compensation circuit coupled to a reference voltage generator in accordance with another embodiment of the present invention.

FIG. 15 is a circuit schematic of a compensated reference voltage generation circuit 40B in accordance with another embodiment of the present invention. Compensated reference voltage generation circuit 40B comprises reference voltage generator circuit 12, driver 42, impedance element 46, impedance element 48, transconductance circuit 88A, and transconductance circuit 88B described with reference to FIG. 14, wherein impedance element 48, transconductance circuit 88A, and transconductance circuit 88B form a compensation circuit 16A2 in a similar configuration to compensation circuit 16A1. Compensation circuit 16A2 further includes a transconductance circuit 88C having an noninverting input connected to the noninverting input of transconductance circuit 88A, an inverting input connected to the noninverting input of transconductance circuit 88B, and an output connected to the cathodes of diodes D1 and D2 and to load resistor 98.

Figure 16:
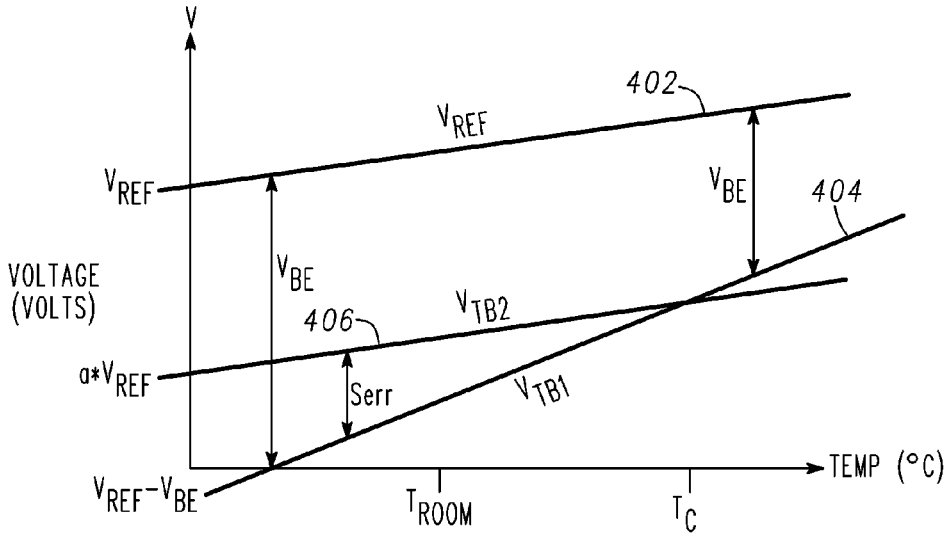
FIG. 16 is a plot of output voltage versus temperature in accordance with an embodiment of the present invention.

FIG. 16 is a plot 400 that illustrates output voltages in response to a range of temperatures. In particular, plot 400 includes a trace 402 of the reference voltage $V_{REF}$ at output 44A of reference voltage compensation circuit 300 shown in FIG. 12. Trace 402 shows that reference voltage $V_{REF}$ increases as temperature increases. In other embodiments, reference voltage $V_{REF}$ may decrease as temperature increases. In response to reference voltage $V_{REF}$, impedance network 46F generates a voltage $V_{TB1}$ at node 12 and impedance network 48B generates a voltage $V_{TB2}$ at node 76B. Voltage $V_{TB1}$ is shown on plot 400 as trace 404 and voltage $V_{TB2}$ is shown on plot 400 as trace 406. Voltage $V_{TB1}$ is the difference between voltage $V_{REF}$ and the base-emitter voltage $V_{BE}$ of transistor 304, i.e., $V_{TB1}=V_{REF}-V_{BE}$. It should be noted that voltage $V_{BE}$ has a negative temperature coefficient in which voltage $V_{BE}$ decreases at a rate of about 2.1 millivolts per degree Celsius (° C.) increase in temperature. Thus, the difference between reference voltage $V_{REF}$ and voltage $V_{TB1}$ decreases as temperature increases. Voltage $V_{TB2}$ is the voltage generated at node 76B and is generated by a voltage divider comprising resistors 70B and 80B. Voltage $V_{TB2}$ results from multiplying voltage $V_{REF}$ by a divider factor "a", wherein a is less than one. The difference between voltage $V_{TB1}$ and $V_{TB2}$ serves as the input voltage across inputs 90 and 94 of transconductance circuit 88 and may be referred to as an error signal Serr. It should be noted that at temperature $T_C$, the values of the impedances are trimmed such that voltages $V_{TB1}$ and $V_{TB2}$ are equal, i.e., traces 402 and 404 intersect. Thus, error signal Serr is zero at temperature $T_C$.

Figure 17:
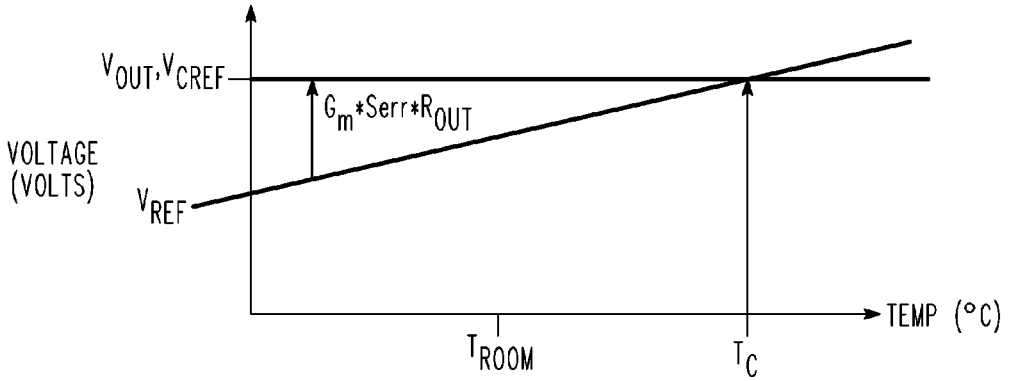
FIG. 17 is a plot of output voltage versus temperature in accordance with an embodiment of the present invention.

FIG. 17 is a plot 420 that illustrates compensated output voltage in response to a range of temperatures. In particular, plot 420 includes a trace 422 of the voltage $V_{REF}$ at output 44A of reference voltage compensation circuit 300. Like trace 402, trace 422 shows that voltage $V_{REF}$ increases as temperature increases. Reference voltage compensation circuit 300 adjusts reference voltage $V_{REF}$ by multiplying reference voltage $V_{REF}$ with an adjustment factor "k", wherein adjustment factor k is equal to the product of the transconductance of transconductance circuit 88, error signal Serr, and the resistance value, $R_{98}$, of resistor 98. It should be noted that resistor 98 may be referred to as an output resistance Rout. Accordingly, adjustment term k equals $Gm*Serr*R_{98}=Gm*Serr*Rout$. It should be noted that plots 400 and 420 have been described with reference to reference voltage compensation circuit 300 shown in FIG.

11. However, the description can apply to compensation circuits 125, 150, 175, and 200, of FIGS. 6, 7, 8, and 9, respectively, and with modifications that replace voltage $V_{BE}$ with the appropriate voltage to compensation circuits 10, 10A, 40, 225, and 300 of FIGS. 1, 3, 4, 10, and 12, respectively and to circuit 100 shown in FIG. 5.

FIG. 18 is a plot 430 that illustrates compensation of reference voltage $V_{REF}$ that appears at output 44 of compensated reference voltage generation circuit 40A shown in FIG. 14. Plot 430 illustrates that different correction factors can be used for temperatures that are below room temperature $T_{ROOM}$ and for temperatures that are above room temperature $T_{ROOM}$. It should be noted that the use of room temperature $T_{ROOM}$ is merely for the purpose of an example wherein it is assumed that voltage $V_{TB1}$ is trimmed to be equal to voltage $V_{TB2}$. Other temperatures may be used instead of room temperature $T_{ROOM}$, wherein it is assumed that at the selected temperature voltage $V_{TB1}$ is trimmed to be equal to voltage $V_{TB2}$. As the temperature increases from a lower temperature $T_{LOWER}$ to a room temperature $T_{ROOM}$, reference voltage $V_{REF}$, illustrated by trace 432, increases, and as the temperature decreases from temperature $T_{ROOM}$ to temperature $T_{HIGHER}$ reference voltage $V_{REF}$ decreases. Trace 434 shows that reference voltage $V_{REF}$ of voltage generator 12 exhibits a nonmonotonic behavior over temperature in the sense that it is increasing for temperatures lower than temperature $T_{ROOM}$ and is decreasing for temperatures higher than temperature $T_{ROOM}$. Trace 432 illustrates the target value minus the compensation term k described above. Compensation term k is positive for all values of temperature. Thus, for temperatures T that are less than temperature $T_{ROOM}$, compensation term k is added to reference voltage $V_{REF}$ to obtain a target value of output voltage $V_{OUT}$ and for temperatures greater than room temperature $T_{ROOM}$, compensation term k is also added to reference voltage $V_{REF}$ to obtain a target value of output voltage $V_{OUT}$.

By now it should be appreciated that a reference voltage compensation circuit and a method for compensating for temperature variations in a reference voltage reference voltage generation circuit have been provided. In accordance with an embodiment, temperature compensation circuit that compensates for temperature variation of a reference voltage, comprises a reference voltage generator circuit having an output and first and second impedance branches coupled to the output. The first impedance branch is connected to a first input of a transconductance generation circuit and the second impedance branch is connected to the second input of the transconductance generation circuit. An error signal is generated at an input of the transconductance generation circuit. In accordance with an embodiment, the reference voltage generation circuit is configured to generate an error signal Serr at any temperature, wherein an error signal Serr different from zero will be present at the input of the transconductance and error signal Serr will equal zero at a chosen temperature $T_C$. In addition, the correction factor to the output can be chosen so that the sum of the correction factor and the incoming reference realizes an output $V_{OUT}$ that has a desired temperature coefficient by trimming the gain and sign of the transconductance or trimming the output resistance value. Thus output voltage $V_{OUT}$ may be given as:

$$V_{OUT}=V_{REF}+\text{Gain}*\text{Serr}*R_{OUT}=V_{REF}(T)+R_{OUT}*\text{Gm}*\text{Serr}(T)=V_{TARGET}$$

In addition, the circuit and method are suitable for trimming the temperature coefficient of a current source, or the frequency of an oscillator, or any other desired parameter. Trimming can be achieved at a second temperature without impacting the parameter values obtained for trimming at the first temperature, i.e., trimming at different temperatures is independent from each other because error signal Serr equals zero at the first temperature. Temperature compensation by the compensation circuit is continuous in time and temperature.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. A method of compensating for temperature variation of a reference voltage, comprising:

providing a reference voltage, wherein a voltage value of the reference voltage varies over temperature;

applying the reference voltage to a first impedance network and to a second impedance network, wherein the first impedance network includes a first impedance element with a first temperature coefficient and the second impedance network includes a second impedance element having a second temperature coefficient, the second temperature coefficient different from the first temperature coefficient, and wherein the first impedance network includes a first node coupled to a first input of a transconductance circuit, and the second impedance network includes a second node and a terminal, the second node coupled to a second input of a transconductance circuit and the terminal coupled to an output of the transconductance circuit;

generating a first voltage and a second voltage in response to the reference voltage applied to the first impedance network and to the second impedance network;

generating a compensation signal at the output of the transconductance amplifier in response to the first voltage and the second voltage.

2. The method of claim 1, wherein the first voltage and the second voltage form a differential voltage and wherein generating the compensation signal includes at least one of:

generating an error current in response to the differential voltage; or generating an error voltage in response to the error current.

3. The method of claim 2, further including adding the error voltage to the reference voltage to generate a temperature compensated reference voltage.

4. The method of claim 3, further including generating the first voltage in response to applying the reference voltage to the first impedance network and generating the second voltage in response to applying the reference voltage to the second impedance network.

5. The method of claim 2, further including generating the error current in response to applying the differential reference voltage to the transconductance circuit.

6. The method of claim 5, wherein using the error current to generate the temperature compensated reference voltage includes directing the error current through an impedance.

7. The method of claim 5, further including controlling a direction in which the error current flows.

8. The method of claim 5, further including changing the error current proportionally with the transconductance.

9. The method of claim 2, wherein generating the compensation signal in response to the first voltage and the second voltage includes injecting the error current into a bandgap reference circuit.

10. The method of claim 1, wherein generating the first voltage and the second voltage further includes trimming the at least one of the first voltage and the second voltage to be equal at a first temperature.

11. The method of claim 1, wherein the first impedance network includes a third impedance element, the third impedance element coupled to the first impedance element at the first node and wherein the second impedance network includes a fourth impedance element coupled to the second impedance element at the second node, and wherein generating the first voltage and the second voltage in response to the reference voltage applied to the first impedance element and to the second impedance element includes generating the first voltage at the first node and generating the second voltage at the second node.

12. The method of claim 11, wherein the first voltage and the second voltage form a differential voltage.

13. The method of claim 11, further including setting the first and second voltages to be equal at a first temperature.

14. The method of claim 13, further including generating an error current in response to the differential voltage using a transconductance parameter.

15. A temperature compensation circuit that compensates for temperature variation of a reference voltage, comprising:

a first impedance branch coupled for receiving the reference voltage;

a second impedance branch coupled for receiving the reference voltage; and a transconductance generation circuit having a differential input and a single ended output, the differential input comprising a first input and a second input, the first impedance branch coupled to the first input and the second impedance branch coupled to the second input, wherein the first impedance branch comprises:

a first resistor having first and second terminals, the first terminal of the first resistor coupled to the output of a voltage reference generator circuit;

and the second impedance branch comprises:

a second resistor having first and second terminals, the first terminal of the second resistor coupled to the output of the voltage reference generator circuit, wherein the first resistor has a first temperature coefficient and the second resistor has a second temperature coefficient, the second temperature coefficient different from the first temperature coefficient; and a third resistor having first and second terminals, the first terminal of the third resistor coupled to the single ended output of the transconductance generation circuit and the second terminal of the third resistor coupled to the output of the voltage reference circuit.

16. The temperature compensation circuit of claim 15, wherein the first source of potential and the second source of potential are the same source of potential.

17. A temperature compensation circuit that compensates for temperature variation of a reference voltage, comprising:

a first impedance branch coupled for receiving a reference voltage, the first impedance branch comprising:

a transistor having a control terminal, a first current carrying terminal, and a second current carrying terminal, the control terminal coupled to the output of a reference voltage generator circuit, and the first current carrying terminal coupled for receiving a first source of potential; and a first resistor having a first terminal and a second terminal and a first temperature coefficient, the first terminal of the first resistor coupled to the second current carrying terminal of the transistor, and the second terminal of the first resistor coupled for receiving a second source of potential;

a second impedance branch coupled for receiving the reference voltage, wherein the second impedance branch comprises a first impedance element having a first terminal and a second terminal, the first terminal of the first impedance element coupled to the control terminal of the transistor, the second terminal of the first impedance element coupled to the first terminal of a second impedance element to form a connection node and the second terminal of the second impedance element coupled for receiving a ground supply; and a transconductance generation circuit having a first input, a second input, and an output, the first input of the transconductance generation circuit coupled to the second current conducting terminal of the transistor and the second input coupled to the second terminal of the first impedance element.

18. A temperature compensation circuit that compensates for temperature variation of a reference voltage, comprising:

a first impedance branch coupled for receiving a reference voltage;

a second impedance branch coupled for receiving the reference voltage; and a transconductance generation circuit having a differential input and a single ended output, the differential input comprising a first input and a second input, the first impedance branch coupled to the first input and the second impedance branch coupled to the second input, wherein the first impedance branch comprises:

a first resistor having first and second terminals, the first terminal of the first resistor coupled to the output of the voltage reference generator circuit;

a second resistor having first and second terminals, the first terminal of the second resistor coupled to the second terminal of the first resistor to form a first node and the second terminal of the second resistor coupled for receiving a first source of potential, the first node coupled to the first input of the transconductance generation circuit; and the second impedance branch comprises:

a third resistor having first and second terminals, the first terminal of the third resistor coupled to the output of the voltage reference generator circuit; and a fourth resistor having first and second terminals, the first terminal of the fourth resistor coupled to the second terminal of the third resistor to form a second node and the second terminal of the fourth resistor coupled for receiving a second source of potential, the second node coupled to the second input of the transconductance generation circuit; and a fifth resistor having first and second terminals, the first terminal of the fifth resistor coupled to the output of the voltage reference generator circuit and the second terminal of the fifth resistor coupled to the output of the transconductance generation circuit.

19. The temperature compensation circuit of claim 18, wherein at least one of the first resistor, the second resistor, the third resistor, and the fourth resistor has a different temperature coefficient from the other resistors.

20. A temperature compensation circuit that compensates for temperature variation of a reference voltage, comprising:

a reference voltage generation circuit having an output;

a first impedance branch coupled for receiving the reference voltage, wherein the first impedance branch comprises:

a transistor having a control terminal, a first current carrying terminal, and a second current carrying terminal, the control terminal coupled to the output of the reference voltage generation circuit, the first current carrying terminal coupled for receiving a first source of potential and a current source having a first terminal and a second terminal, the first terminal of the current source coupled to the second current carrying terminal of the transistor and the second terminal of the current source coupled for receiving a second source of potential;

a second impedance branch having a first terminal, a second terminal, and a connection node, the first terminal coupled for receiving the reference voltage and the second terminal coupled for receiving a third source of potential; and a transconductance generation circuit having a first input, a second input, and an output, the first input of the transconductance generation circuit coupled to the second current carrying terminal of the transistor and the second input of the transconductance generation circuit coupled to the connection node of the second impedance branch.

21. The temperature compensation circuit of claim 20, wherein the second impedance branch comprises:

a first resistor having a first terminal and a second terminal, the first terminal of the first resistor serving as the first terminal of the second impedance branch and coupled to the output of the reference voltage generation circuit; and a second resistor having a first terminal and a second terminal, the first terminal of the second resistor coupled to the second terminal of the first resistor to form the connection node, and the second terminal of the second resistor coupled for receiving the third source of potential.

* * * * *